US011326549B2

(12) United States Patent
Hopf et al.

(10) Patent No.: US 11,326,549 B2
(45) Date of Patent: May 10, 2022

(54) 218-0266 VOLCANO-SHAPED INLET OF PISTON OIL-COOLING GALLERY

(71) Applicant: Ford Global Technologies, LLC, Dearborn, MI (US)

(72) Inventors: Anselm Hopf, Grevenbroich (DE); Frank Kraemer, Neunkirchen-Seelscheid (DE); Carsten Weber, Leverkusen (DE); Paul Turner, Chelmsford (GB); Klaus-Peter Heinig, Aachen (DE); Loic Wendling, Aachen (DE); Marek Behr, Aachen (DE); Kai-Martin Mayer, St. Augustin (DE); Guenter Bartsch, Gummersbach (DE); Kai Kuhlbach, Bergisch Gladbach (DE); Bernd Steiner, Duesseldorf (DE); Guenter Grosch, Vettweiß (DE)

(73) Assignee: Ford Global Technologies, LLC, Dearborn, MI (US)

( * ) Notice: Subject to any disclaimer, the term of this patent is extended or adjusted under 35 U.S.C. 154(b) by 1 day.

(21) Appl. No.: 17/154,960

(22) Filed: Jan. 21, 2021

(65) Prior Publication Data

US 2021/0222646 A1 Jul. 22, 2021

(30) Foreign Application Priority Data

Jan. 21, 2020 (DE) ..... 102020000317.6
Jan. 21, 2020 (DE) ..... 102020000320.6
Jan. 21, 2020 (DE) ..... 102020000321.4

(51) Int. Cl.
*F02F 3/22* (2006.01)
*F01P 3/10* (2006.01)
*F01P 3/00* (2006.01)

(52) U.S. Cl.
CPC ..... *F02F 3/22* (2013.01); *F01P 3/10* (2013.01); *F01P 2003/006* (2013.01)

(58) Field of Classification Search
CPC ..... F02F 3/22; F02F 3/02; F02F 3/16; F02F 3/0076; F01P 3/10; F01P 3/06; F01P 3/08; F01P 7/14; F01P 2003/006; F01M 1/08
See application file for complete search history.

(56) References Cited

U.S. PATENT DOCUMENTS 3,221,718 A 12/1965 Isley
4,175,502 A 11/1979 Moebus
5,595,145 A * 1/1997 Ozawa ..... F02F 3/22 123/41.35
5,730,090 A * 3/1998 Kling ..... F01P 3/08 123/41.35

(Continued)

FOREIGN PATENT DOCUMENTS

DE 3518721 A1 11/1986
DE 102012211060 A1 4/2014
KR 101371313 B1 3/2014

*Primary Examiner* — Grant Moubry
(74) *Attorney, Agent, or Firm* — Geoffrey Brumbaugh; McCoy Russell LLP

(57) ABSTRACT

Methods and systems are provided for an oil gallery of a piston. In one example, a system for a piston comprising an internal oil gallery. The internal oil gallery comprises one or more of a funnel shaped inlet, a funnel shaped outlet, and a plurality of tongues extending along a circumference of the internal oil gallery.

18 Claims, 7 Drawing Sheets

(56) References Cited

U.S. PATENT DOCUMENTS

| | | | | |
|---|---|---|---|---|
| 6,164,249 | A * | 12/2000 | Honold | F02F 3/22 123/41.35 |
| 7,051,684 | B2 | 5/2006 | Bauer | |
| 7,748,361 | B2 * | 7/2010 | Linz | F02F 3/22 123/193.6 |
| 8,511,261 | B2 * | 8/2013 | Maruyama | F02F 3/22 123/41.35 |
| 8,733,315 | B2 * | 5/2014 | Kollotzek | B22C 9/105 123/193.1 |
| 8,739,755 | B2 * | 6/2014 | Stan | F02F 3/003 123/193.6 |
| 8,973,548 | B2 * | 3/2015 | Andreas | F02F 3/225 123/193.2 |
| 9,109,530 | B2 * | 8/2015 | Bischofberger | F01P 3/10 |
| 9,382,869 | B2 * | 7/2016 | Freidhager | F02F 3/16 |
| 9,650,988 | B2 * | 5/2017 | Schneider | F02F 3/003 |
| 10,060,327 | B2 * | 8/2018 | Park | F02F 3/22 |
| 2002/0056367 | A1 * | 5/2002 | Bochart | F16J 1/08 92/239 |
| 2005/0072386 | A1 * | 4/2005 | Gabriel | F02F 3/22 123/41.35 |
| 2015/0184613 | A1 * | 7/2015 | Linke | F02B 23/0672 123/41.35 |
| 2017/0314504 | A1 * | 11/2017 | Yoo | B22C 9/105 |
| 2017/0314505 | A1 * | 11/2017 | Boczek | F02F 3/22 |
| 2017/0321629 | A1 * | 11/2017 | Boczek | F02F 3/10 |
| 2019/0218997 | A1 * | 7/2019 | Yang | F02F 3/22 |
| 2019/0323450 | A1 * | 10/2019 | Luz | F02F 3/22 |

* cited by examiner

218-0266 VOLCANO-SHAPED INLET OF PISTON OIL-COOLING GALLERY

CROSS REFERENCE TO RELATED APPLICATION

The present application claims priority to German Patent Application No. 102020000317.6 filed on Jan. 21, 2020. The present application also claims priority to German Patent Application No. 102020000320.6 filed on Jan. 21, 2020. The present application also claims priority to German Patent Application No. 102020000321.4 filed on Jan. 21, 2020. The entire contents of the above-referenced applications are hereby incorporated by reference for all purposes.

FIELD

The present description relates generally to an inlet of a piston oil-cooling gallery and a method for producing the piston.

BACKGROUND/SUMMARY

An internal combustion engine may be used in a motor vehicle drive unit. Within the context of the present disclosure, the expression "internal combustion engine" encompasses diesel engines and Otto-cycle engines, but also hybrid internal combustion engines, that is to say internal combustion engines which are operated with a hybrid combustion process, and hybrid drives which, in addition to the internal combustion engine, comprise at least one further torque source for driving a motor vehicle, for example an electric machine which is connectable in terms of drive or connected in terms of drive to the internal combustion engine and which outputs power instead of the internal combustion engine or in addition to the internal combustion engine.

Internal combustion engines have a cylinder block and at least one-cylinder head which may be connectable to one another or connected to one another in order to form the individual cylinders, that is to say combustion chambers. The individual components will be discussed briefly below.

The cylinder head may serve to hold the control elements, and in the case of an overhead camshaft, to hold the valve drives in their entirety. During the charge exchange, the combustion gases may be discharged via the at least one outlet opening and the charging of the combustion chamber takes place via the at least one inlet opening of each cylinder. To control the charge exchange, in four-stroke engines, lifting valves may be used as control elements, which lifting valves perform an oscillating lifting movement during the operation of the internal combustion engine and thereby open up and close the inlet opening and outlet opening. The valve actuating mechanism desired for the movement of a valve, including the valve itself, is referred to as the valve drive.

In applied-ignition internal combustion engines, the desired ignition device, and in the case of direct-injection internal combustion engines furthermore the injection device, may also be arranged in the cylinder head. To form a functionally suitable connection, which seals off the combustion chambers, of cylinder head and cylinder block, an adequately large number of adequately large bores may be provided.

To hold the pistons, the cylinder block may include a corresponding number of cylinder bores or cylinder liners. The piston of each cylinder of an internal combustion engine may be guided in an axially movable manner along the cylinder longitudinal axis in a cylinder barrel and, together with the cylinder barrel and the cylinder head, delimits the combustion chamber of a cylinder. Here, the piston crown may form a part of the combustion chamber inner wall, and, together with the piston rings, seals off the combustion chamber with respect to the cylinder block or the crankcase, such that no combustion gases or no combustion air passes into the crankcase, and no oil passes into the combustion chamber. The cylinder barrel may be formed either using a cylinder liner that is insertable into the cylinder block or directly by the cylinder block itself, specifically the cylinder bore.

The piston may serve to transmit the gas forces generated by the combustion to the crankshaft. For this purpose, each piston may be articulatedly connected via a piston pin to a connecting rod, which in turn is movably mounted on the crankshaft.

The crankshaft, which is mounted in the crankcase, may absorb the connecting rod forces, which are composed of the gas forces as a result of the fuel combustion in the combustion chamber and the inertia forces as a result of the non-uniform movement of the engine parts. Here, the oscillating stroke movement of the pistons may be transformed into a rotating rotational movement of the crankshaft. The crankshaft transmits the torque to the drivetrain. A part of the energy transmitted to the crankshaft may be used for driving auxiliary units such as the oil pump and the alternator, or serves for driving the camshaft and therefore for actuating the valve drives.

Generally, and within the context of the present disclosure, the upper crankcase half may be formed by the cylinder block. The crankcase is generally complemented by the lower crankcase half which can be mounted on the upper crankcase half and which serves as an oil pan.

To hold and mount the crankshaft, at least two bearings may be provided in the crankcase. To supply the bearings with oil, a pump for conveying engine oil to the at least two bearings may be provided, with the pump supplying engine oil via a supply line to a main oil gallery, from which channels lead to the at least two bearings. To form the so-called main oil gallery, a main supply channel may be provided which is aligned along the longitudinal axis of the crankshaft. The main supply channel may be arranged above or below the crankshaft in the crankcase or else integrated into the crankshaft.

The pump itself may be supplied with engine oil originating from the oil pan via a suction line which leads from the oil pan to the pump, and the pump may ensure an adequately high feed flow, that is to say an adequately high feed volume, and an adequately high oil pressure in the supply system, in particular in the main oil gallery.

The supply of oil to a camshaft may take place analogously. Further, consumers that consume or demand engine oil, that is to say which may be supplied with engine oil, in order to perform and maintain their function may be the bearings of a connecting rod or of a balancing shaft that may be provided. Likewise, a consumer in the above sense may include an oil spray cooling arrangement which, for the purpose of cooling, wets the piston crown with engine oil via a nozzle from below, that is to say at the crankcase side. The oil spray cooling arrangement may demand or consumes oil, that is to say the oil spray cooling arrangement may be supplied with oil.

The oil spray cooling arrangement of a piston, which sprays the piston crown with engine oil for the purposes of cooling, may desire engine oil which is as cool or as cold as possible, that is to say engine oil of the lowest possible temperature, in order to be able to extract the greatest possible amount of heat from the piston. It is thus sought to mitigate thermal overloading or overheating of the piston.

In this context, it may be taken into consideration that internal combustion engines are increasingly more commonly being supercharged. For example, via an exhaust-gas turbocharger or mechanical or electric supercharger, in order to lower fuel consumption, that is to say improve efficiency. As a result, both the thermal load and the mechanical load on the internal combustion engine and on the piston increase, such that increased demands may be placed on the cooling arrangement, and measures may be implemented which allow for the thermal and mechanical loading.

The cylinder block of an internal combustion engine may also be a component that is subject to high thermal and mechanical loading. On account of the higher heat capacity of liquids in relation to air, it is possible for significantly greater quantities of heat to be dissipated using a liquid-type cooling arrangement than is possible using an air-type cooling arrangement. For this reason, internal combustion engines may be equipped with a liquid-type cooling arrangement.

A liquid-type cooling arrangement may demand that the internal combustion engine or the cylinder block be equipped with at least one integrated coolant jacket, which conducts the coolant through the cylinder block. The heat dissipated to the coolant may be extracted from the coolant again for example in a heat exchanger. Here, the coolant may be delivered via a pump arranged in the coolant circuit, such that said coolant circulates.

Like the cylinder block, the cylinder head may also be equipped with one or more coolant jackets. The cylinder head may be a thermally more highly loaded component because, by contrast to the cylinder block, the head may be provided with exhaust-gas-conducting lines, and the combustion chamber walls which are integrated in the head are exposed to hot exhaust gas for longer than the cylinder barrels provided in the cylinder block. Furthermore, the cylinder head may include a lower component mass than the block.

The large temperature differences in the cylinder block in an internal combustion engine which is in operation result in greater or lesser thermal distortion of the cylinder barrel of a cylinder. This so-called bore distortion may include numerous undesired effects in practice. In order that the piston in interaction with the cylinder barrel and the piston rings can seal off the combustion chamber with respect to the crankcase in an effective manner despite bore distortion, the preload forces of the rings are, according to the prior art, increased, though this disadvantageously likewise increases the friction or friction losses of the internal combustion engine. It is however basically sought to minimize the friction losses of an internal combustion engine in order to reduce the fuel consumption and thus also the pollutant emissions.

Effective cooling of the piston opposes the effects described above. In one example, the issues described above may be addressed by a system, comprising a piston configured to oscillate along an axis and an oil gallery arranged within the piston configured to route oil circumferentially about the axis, wherein an inlet of the oil gallery comprises a funnel shape narrowing in width in a downstream direction relative to a direction of oil flow from a nozzle to the oil gallery. In this way, the flow into and through the oil gallery may be enhanced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2A-5 and 7-8B are shown approximately to scale, however, other relative dimensions may be used if desired.

DETAILED DESCRIPTION

The following description relates to an inlet of an oil gallery. The pistons of the internal combustion engine of the present disclosure may include an oil-type cooling arrangement, wherein the piston crown of each piston is not only sprayed with engine oil via an oil spray cooling arrangement. According to the disclosure, it is rather the case that each piston is equipped with an oil gallery which has channels integrated into the piston and which conduct oil via the channels through the piston for the purposes of cooling.

Figure 1:
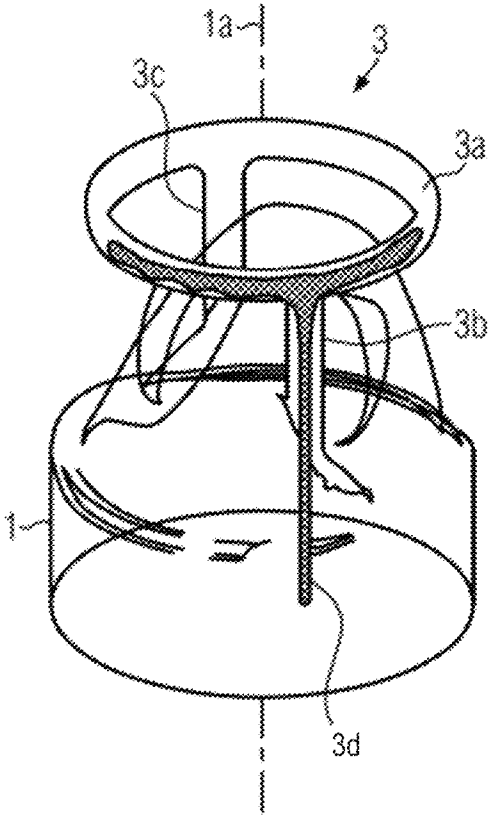
FIG. 1 (Prior art)
FIG. 1 shows, schematically and in a perspective view, the oil gallery together with the inlet channel and the outlet channel and a section of the cylinder barrel according to the prior art.

According to the prior art, such an oil gallery comprises a ring-shaped channel, a neck-like inlet for supplying oil to the ring channel, and a neck-like outlet for discharging the oil from the ring channel, as shown in FIG. 1. Here, the feed of oil into the ring channel of the oil gallery generally takes place by injection into the inlet neck, specifically using an injection nozzle which is positionally fixed with respect to the cylinder block and which is supplied with oil via the main oil gallery. The injected oil has a certain conveying effect on the oil already situated in the ring channel, and conveys said oil in the direction of the outlet. The discharge of the oil from the ring channel is however in particular dominated by the oscillating movement of the piston.

Tests have shown that the large quantities of the oil injected into the inlet may not pass into the ring channel, or do not remain in the ring channel, but rather exit the oil gallery again via the inlet without flowing through the ring channel. Conveyance of the oil through the ring channel or through the oil gallery, which is a prerequisite for effective piston cooling, does not take place here.

In one example, the oil-type cooling arrangement of the piston of the present disclosure may enhance cooling of the piston.

In some examples, a method for producing a piston of an internal combustion engine, wherein at least one-cylinder block, which is connected to the at least one cylinder head and which serves as an upper crankcase half, for accommodating at least one piston, in the internal combustion engine. Each cylinder comprises a combustion chamber which is jointly formed by a piston crown of the cylinder-specific piston, by a cylinder barrel and by the at least one cylinder head, wherein the piston is displaceable in translational fashion along a cylinder longitudinal axis between a top dead center TDC and a bottom dead center BDC, forming a piston stroke s. Each piston is, to form an oil-type cooling arrangement, equipped with an oil gallery which is integrated in the piston crown and which comprises a ring-shaped channel, an inlet channel which is connected to the ring-shaped channel and which serves for supplying oil to the ring-shaped channel, and an outlet channel which is connected to the ring-shaped channel and which serves for discharging the oil from the ring-shaped channel.

In some examples, an internal combustion engine includes at least one-cylinder head with at least one cylinder. At least one-cylinder block, which is connected to the at least one cylinder head and which serves as an upper crankcase half, for accommodating at least one piston, in which internal combustion engine. Each cylinder comprises a combustion chamber which is jointly formed by a piston crown of the cylinder-specific piston, by a cylinder barrel and by the at least one-cylinder head, wherein the piston is displaceable in translational fashion along a cylinder longitudinal axis between a top dead center (TDC) and a bottom dead center (BDC), forming a piston stroke s. Each piston is, to form an oil-type cooling arrangement, equipped with an oil gallery which is integrated in the piston crown and which comprises a ring-shaped channel, an inlet channel which is connected to the ring-shaped channel and which serves for supplying oil to the ring-shaped channel, and an outlet channel which is connected to the ring-shaped channel and which serves for discharging the oil from the ring-shaped channel, which internal combustion engine is characterized in that the inlet channel is formed so as to taper in a funnel shape in the direction of the ring-shaped channel and projects into the ring-shaped channel so as to form a cone.

The oil jet which emerges from an injection nozzle and which, for the purposes of supplying oil, is oriented toward the inlet channel is not a purely laminar focused jet but rather is an oil jet which widens to a greater or lesser extent in the direction of the inlet channel, specifically inter alia because an intense turbulent air movement is present in the crankcase. This circumstance is allowed for by the fact that, according to the disclosure, the inlet channel tapers in a funnel shape in the direction of the ring-shaped channel. Here, it is not necessary for the inlet channel to taper continuously over its entire length. In order for the widening oil jet to be focused again or captured, it may suffice in individual cases for the inlet channel to taper in a funnel shape in certain sections, that is to say over a limited distance.

By virtue of the fact that the inlet channel is of funnel-shaped form, that fraction of the oil emerging from the injection nozzle which passes via the inlet channel into the ring channel is maximized or greatly enlarged.

The inlet channel according to the disclosure projects into the ring-shaped channel and, in so doing, forms a cone. This has the advantageous effect that the oil introduced via the inlet channel into the ring-shaped channel is diverted onto that wall of the ring channel which is situated opposite the cone, wherein the oil jet that impinges on the wall is split up and is directed to both sides of the cone into the ring channel.

The diversion and introduction of the oil to both sides into the ring-shaped channel is assisted by the conical end of the inlet channel which projects into the ring-shaped channel, and it is ensured that as much of the introduced oil as possible remains in the ring channel and as little of the introduced oil as possible exits the ring channel again without flowing through the ring channel and cooling the piston crown.

The physical features of the inlet channel according to the disclosure described above, and the technical effects resulting from said features, increase the oil quantity that is conveyed through the ring channel or the oil gallery and the conveying speed, and thus intensify the cooling of the piston crown. The result is more effective piston cooling.

The internal combustion engine according to the disclosure is improved with regard to the oil-type cooling arrangement of the piston and in particular ensures more effective cooling of the piston.

Embodiments of the internal combustion engine may comprise where the inlet channel and/or the outlet channel is oriented parallel to the cylinder longitudinal axis. This ensures a certain symmetry and equal treatment of the ring channel sections to both sides of the cone of the inlet channel.

Embodiments of the internal combustion engine may comprise where an injection nozzle which is arranged so as to be positionally fixed relative to the cylinder block is provided for supplying oil to the ring-shaped channel.

In this context, embodiments of the internal combustion engine may comprise where the inlet channel, which is of funnel-shaped form at least in certain sections, has a minimum diameter $D_{min}$, where $D_{min}>d_{oil}$, wherein $d_{oil}$ denotes the diameter of an outlet opening of the injection nozzle.

Embodiments of the internal combustion engine may comprise where the inlet channel, which is of funnel-shaped form at least in certain sections, has a maximum diameter $D_{max}$, where $D_{max}>1.5\ D_{min}$, wherein $D_{min}$ denotes a minimum diameter of the inlet channel, which is of funnel-shaped form at least in certain sections.

In this context, embodiments of the internal combustion engine may comprise where the following applies: $D_{max}>2 D_{min}$.

In this context, embodiments of the internal combustion engine may comprise where the following applies: $D_{max}>3 D_{min}$ or $D_{max}>4 D_{min}$ or $D_{max}>5 D_{min}$.

Embodiments of the internal combustion engine may comprise where the ring-shaped channel is equipped, on the side situated opposite the cone, with a wedge which projects into the ring-shaped channel.

The wedge assists the effect whereby the oil that is introduced via the inlet channel into the ring-shaped channel is directed to both sides of the cone into the ring channel, and thus contributes to more effective piston cooling.

In this context, embodiments of the internal combustion engine may comprise where the wedge extends and is oriented parallel to the cylinder longitudinal axis.

Embodiments of the internal combustion engine are advantageous in which the inlet channel and the outlet channel are arranged offset with respect to one another by an angle $\alpha$ about the cylinder longitudinal axis.

Strictly speaking, two angles are formed if the inlet channel and the outlet channel are arranged offset with respect to one another about the cylinder longitudinal axis, because the inlet channel and the outlet channel are connected to one another via two ring channel sections. Proceeding from the inlet channel, the outlet channel can be reached clockwise or counterclockwise via the ring channel. It is advantageously the case that the angle is $\alpha \approx 180°$, or both angles are $\alpha \approx 180°$.

In this context, embodiments of the internal combustion engine may comprise where the following applies: $\alpha>140°$. The larger the angle, the greater is the minimum distance that the oil introduced into the ring-shaped channel must cover in the ring channel.

Embodiments of the internal combustion engine may comprise where the outlet channel is formed so as to taper in a funnel shape proceeding from the ring-shaped channel and protrudes from the piston crown so as to form a cone.

The oscillating stroke movement of the piston during the operation of the internal combustion engine generally has the effect that oil that has already been discharged into the crankcase passes into the outlet channel again, and via the outlet channel into the ring channel. This effect fundamentally impedes the discharge of the oil from the oil gallery.

In one example, in which the outlet channel narrows in a funnel shape and protrudes from the piston crown so as to form a cone, counteracts this disadvantageous effect. Owing to the intense turbulence in the crankcase and the oscillating stroke movement of the piston, oil that has already been discharged into the crankcase is captured to both sides of the cone of the outlet channel. A re-entry of oil into the outlet channel and the ring channel is impeded.

Embodiments of the internal combustion engine may comprise where pockets or recesses are provided in the piston crown to both sides of the cone of the outlet channel, in which pockets or recesses it is possible for oil that has been discharged via the outlet channel into the crankcase to be collected.

Embodiments of the internal combustion engine may comprise where the cone of the inlet channel and/or the cone of the outlet channel has a concave outer cone lateral surface.

A concave outer cone lateral surface assists, at the inlet side, the feed of oil and the introduction into the ring-shaped channel and, at the outlet side, the capture and discharge of oil that is situated in the crankcase.

Embodiments of the internal combustion engine may comprise where an injection nozzle is spraying under an angle $\beta$ towards the gallery inlet for supplying oil to the ring-shaped channel, e.g. $\beta<30°$. In one example, the injection nozzle is configured to spray the oil jet with an axis that is angled to (e.g., not parallel to) a cylinder longitudinal axis.

The second sub-object on which the disclosure is based, specifically that of specifying a method for producing a piston of an internal combustion engine of a type described above, is achieved by way of a method which is distinguished by the fact that the piston is produced by means of an additive manufacturing process, in which the piston is built up in layered fashion.

That which has already been stated with regard to the internal combustion engine according to the disclosure also applies to the method according to the disclosure.

Embodiments of the method may comprise where the piston is produced at least inter alia by means of 3D printing.

Manufacturing methods in which the piston is produced by casting with subsequent cutting machining may be desired.

The oscillating stroke movement of the piston during the operation of the internal combustion engine generally has the effect, at the outlet side, that oil that has already been discharged into the crankcase passes into the outlet channel again, and via the outlet channel back into the ring channel. This effect fundamentally impedes the discharge of the oil from the oil gallery. This is caused by the fact that the piston moving downward from top dead center again captures oil that has already been discharged. This disadvantageous effect is assisted by intense turbulence in the crankcase.

Measures are demanded with which the oil-type cooling arrangement of the piston is improved and more effective cooling of the piston is made possible.

In one example, the engine of the present disclosure is improved with regard to the oil-type cooling arrangement of the piston and in particular ensures more effective cooling of the piston.

In one example, a method for producing a piston of an internal combustion engine of said type.

In one embodiment, an internal combustion engine includes at least one cylinder head with at least one cylinder. The engine comprises at least one cylinder block, which is connected to the at least one cylinder head and which serves as an upper crankcase half, for accommodating at least one piston in the internal combustion engine. Each cylinder comprises a combustion chamber which is jointly formed by a piston crown of the cylinder-specific piston, by a cylinder barrel and by the at least one cylinder head, wherein the piston is displaceable in translational fashion along a cylinder longitudinal axis between a top dead center TDC and a bottom dead center BDC, forming a piston strokes. Each piston is, to form an oil-type cooling arrangement, equipped with an oil gallery which is integrated in the piston crown and which comprises a ring-shaped channel, an inlet channel which is connected to the ring-shaped channel and which serves for supplying oil to the ring-shaped channel, and an outlet channel which is connected to the ring-shaped channel and which serves for discharging the oil from the ring-shaped channel. The internal combustion engine is characterized in that the ring-shaped channel has, at least in certain sections, a cross section which comprises a central piece and multiple tongues, wherein the tongues are arranged circumferentially and so as to be oriented outward.

According to the present disclosure, the ring-shaped channel does not have a round or circular cross section throughout in the manner of ring channels of conventional oil-type cooling arrangements according to the prior art.

Rather, the ring channel according to the disclosure has, at least in certain sections, a cross section which deviates from the circular shape or from the round shape.

The ring channel according to the disclosure has, at least in certain sections, a cross section which comprises a central piece and multiple, that is to say at least two, tongues. The tongues are arranged circumferentially around the central piece and are arranged so as to be oriented outward.

Such a cross section greatly increases the size of the heat-transferring area between the ring channel and the piston crown, that is to say between the cooling oil and the piston material that is to be cooled. This results in an increased introduction of heat from the piston into the oil, that is to say intensified cooling of the piston crown. The result is more effective piston cooling.

With the internal combustion engine according to the disclosure, an internal combustion engine is provided which is improved with regard to the oil-type cooling arrangement of the piston and in particular ensures more effective cooling of the piston.

Embodiments of the internal combustion engine may comprise where the tongues are arranged circumferentially and so as to be oriented radially outward. Here, the radial orientation is in relation to a central flow filament or the longitudinal axis of the ring channel, along which the ring channel extends and which passes through the central piece.

Embodiments of the internal combustion engine may comprise where the tongues are arranged circumferentially at regular intervals. This ensures a certain symmetry and equal treatment of the circumferential ring channel sections.

Nevertheless, embodiments of the internal combustion engine may comprise where the tongues are arranged circumferentially at irregular intervals.

Embodiments of the internal combustion engine may comprise where at least two tongues are of different size and/or have a different shape.

In particular, however, embodiments of the internal combustion engine may comprise where the tongues are of the same shape and of the same size. Such a configuration of the tongues leads to advantages in the manufacture of the piston; in particular, if the piston is produced in a casting process. Together with an arrangement of the tongues circumferentially at regular intervals, embodiments are obtained in which the cross section of the ring channel has or assumes, at least in certain sections, a flower-shaped form.

Embodiments of the internal combustion engine may comprise where at least one tongue has a polygonal shape.

A polygonal, that is to say multi-sided, tongue has at least three sides. It may be desired for the corners to be rounded. This can lead to enhancements in the manufacture of the piston; in particular, if the piston is produced in a casting process.

Embodiments of the internal combustion engine may comprise where at least one tongue has a triangular shape.

Embodiments of the internal combustion engine may comprise where at least one tongue has a rounded shape.

Embodiments of the internal combustion engine may comprise where at least one tongue has a rectangular shape. The rectangular shape is a specific polygonal shape.

Embodiments of the internal combustion engine may comprise where at least one tongue is trapezoidal. The trapezoid is a specific polygonal shape.

Embodiments of the internal combustion engine may comprise where the cross section winds in spiral fashion around a central flow filament along the ring-shaped channel.

As viewed in the flow direction, the winding of the channel may take place clockwise or counterclockwise. The pitch of the spiral may be uniform over the entire ring channel, though may also vary. The spiral-shaped winding of the cross section ensures an enlargement of the heat-transferring area between the ring channel and the piston crown, that is to say between the oil and the piston material. The result is an increased introduction of heat into the oil. Furthermore, the oil is forced into the tongues or depressions that wind in a spiral shape, and is simultaneously conveyed along the tongues in the direction of an outlet, by the oscillating piston movement. In this way, the warmed oil is moved in a horizontal direction, and discharged, more quickly. The mass flow of the oil through the oil gallery increases and thus improves the cooling of the piston.

Embodiments of the internal combustion engine may comprise where the ring-shaped channel meanders at least in certain sections. This configuration, too, increases the size of the heat-transferring area between the ring channel and the piston crown.

Embodiments of the internal combustion engine may comprise where the ring-shaped channel is stretched or compressed in certain sections with the spiral-shaped winding of the cross section along the central flow filament, that is to say as viewed in a flow direction, whereby the local pitch of the spiral, that is to say of the spiral-shaped winding, can be varied. That is to say, the local pitch of the spiral-shaped winding varies. With this measure, the local horizontal speed of the oil in the direction of an outlet can be varied or adjusted, whereby different cooling of the piston regions can be controlled. For example, the piston side below the exhaust valve or the exhaust valves may be thermally more highly loaded than that of the piston side below the intake valve. A more homogeneous temperature distribution in the piston can be realized by means of the cooling with varying intensity. In this way, the friction and the fuel consumption can be advantageously influenced.

Embodiments of the internal combustion engine may comprise where the ring-shaped channel—preferably with a spiral-shaped winding of the cross section—is smooth, that is to say has no tongues, on the outermost circumference. The advantage of this embodiment is that the intense vertical oscillating movement of the oil in the gallery is not slowed in the central part of the ring channel by the tongues, but is accelerated further in the direction of upper and lower walls, that is to say along the cylinder longitudinal axis, and thus the cooling is improved.

Embodiments of the internal combustion engine may comprise where an injection nozzle which is arranged so as to be positionally fixed relative to the cylinder block is provided for supplying oil to the ring-shaped channel.

An embodiment of the present disclosure comprises an internal combustion engine having at least one cylinder head with at least one cylinder and at least one cylinder block, which is connected to the at least one cylinder head and which serves as an upper crankcase half, for accommodating at least one piston, in which internal combustion engine. Each cylinder comprises a combustion chamber which is jointly formed by a piston crown of the cylinder-specific piston, by a cylinder barrel and by the at least one cylinder head, wherein the piston is displaceable in translational fashion along a cylinder longitudinal axis between a top dead center TDC and a bottom dead center BDC, forming a piston stroke, s. Each piston is, to form an oil-type cooling arrangement, equipped with an oil gallery which is integrated in the piston crown and which comprises a ring-shaped channel, an inlet channel which is connected to the ring-shaped channel and which serves for supplying oil to the ring-shaped channel, and an outlet channel which is connected to the ring-shaped channel and which serves for discharging the oil from the ring-shaped channel, which internal combustion engine is characterized in that the outlet channel has at least one siphon-like section comprising $n \geq 2$ bends through an angle $\gamma_i$, wherein successive bends have different curvatures.

The outlet channel according to the disclosure is equipped with at least one siphon-like section which prevents or impedes a re-entry of oil into the ring-shaped channel. A siphon according to the disclosure comprises at least two bends, wherein successive bends have different curvatures. It may be taken into consideration that the channel can, in a flow direction, bend clockwise to the right and counterclockwise to the left as viewed in the flow direction of the flowing oil. According to the disclosure, the change in direction that the oil or the oil flow undergoes as it passes through a bend owing to the curvature determines the angle $\gamma$ of said bend. The boundary between two successive bends lies at the point or in the region at which or in which the curvature changes.

Oil introduced into the labyrinthine outlet channel flows through a meandering channel system, wherein, with increasing distance covered, and with the passing of every bend, the likelihood of the oil passing back into the ring-shaped channel again decreases.

The oscillating movement of the piston during the operation of the internal combustion engine results in a shaker effect. Owing to the reciprocating movement of the piston, the oil is, as it were, conveyed from the oil gallery into the crankcase by shaking.

With the internal combustion engine according to the disclosure, an internal combustion engine is provided which is improved with regard to the oil-type cooling arrangement of the piston and in particular ensures a more effective discharge of the oil from the oil gallery.

Embodiments of the internal combustion engine may include where the inlet channel and/or the outlet channel is oriented parallel to the cylinder longitudinal axis. This ensures a certain symmetry and equal treatment of the ring channel sections to both sides of the mouth of the inlet channel and to both sides of the branching of the outlet channel.

Embodiments of the internal combustion engine may comprise where an injection nozzle which is arranged so as to be positionally fixed relative to the cylinder block is provided for supplying oil to the ring-shaped channel.

Embodiments of the internal combustion engine may comprise where the outlet channel is formed so as to initially taper in a funnel shape proceeding from the ring-shaped channel. This assists a collection and discharge of oil from the oil gallery and impedes oil that has already been discharged into the crankcase from re-entering the outlet channel and the ring channel. The discharge of the oil from the oil gallery may be enhanced.

Embodiments of the internal combustion engine may comprise where the ring-shaped channel is equipped, on the side situated opposite the outlet channel, with a wedge which projects into the ring-shaped channel.

In this context, embodiments of the internal combustion engine may comprise where the wedge extends and is oriented parallel to the cylinder longitudinal axis. The wedge assists the collection and discharge of oil from the oil gallery or the ring channel.

Embodiments of the internal combustion engine may comprise where the at least one siphon-like section is of substantially S-shaped form. Then, all successive bends have different curvatures, and the bends have a minimum curvature, specifically the curvature desired to form an S, which extends through an angle $\gamma_i \geq 60°$.

Embodiments of the internal combustion engine may comprise where the at least one siphon-like section comprises two bends.

Embodiments of the internal combustion engine may comprise where, for the angle $\gamma_i$, the following applies: $\gamma_i \geq 60$ 5°.

Embodiments of the internal combustion engine may comprise where, for the angle $\gamma_i$, the following applies: $\gamma_i \geq 90°$.

Embodiments of the internal combustion engine may comprise where, for the angle $\gamma_i$, the following applies: $\gamma_i \geq 100°$.

Embodiments of the internal combustion engine may comprise where, for the angle $\gamma_i$, the following applies: $\gamma_i \geq 115°$.

Embodiments of the internal combustion engine may comprise where at least one bend has a pocket or recess in which oil discharged via the outlet channel can collect or be captured.

Embodiments of the internal combustion engine may comprise where the inlet channel is formed so as to taper in a funnel shape in the direction of the ring-shaped channel and/or projects into the ring-shaped channel so as to form a cone.

The oil jet which emerges from an injection nozzle and which, for the purposes of supplying oil, is oriented toward the inlet channel is not a purely laminar focused jet but rather is an oil jet which widens to a greater or lesser extent in the direction of the inlet channel, specifically inter alia because an intense turbulent air movement is present in the crankcase.

This circumstance is allowed for by the fact that the inlet channel tapers in a funnel shape in the direction of the ring-shaped channel. Here, it is not demanded for the inlet channel to taper continuously over its entire length. In order for the widening oil jet to be focused again or captured, it may suffice in individual cases for the inlet channel to taper in a funnel shape in certain sections, that is to say over a limited distance, as illustrated in FIG. 2A.

By virtue of the fact that the inlet channel is of funnel-shaped form, that fraction of the oil emerging from the injection nozzle which passes via the inlet channel into the ring channel is maximized or greatly enlarged.

The inlet channel projects into the ring-shaped channel and, in so doing, forms a cone. This has the enhanced effect that the oil introduced via the inlet channel into the ring-shaped channel is diverted onto that wall of the ring channel which is situated opposite the cone, wherein the oil jet that impinges on the wall is split up and is directed to both sides of the cone into the ring channel.

The diversion and introduction of the oil to both sides into the ring-shaped channel is assisted by the conical end of the inlet channel which projects into the ring-shaped channel, and it is ensured that as much of the introduced oil as possible remains in the ring channel and as little of the introduced oil as possible exits the ring channel again without flowing through the ring channel and cooling the piston crown.

The physical features of the inlet channel described above increase the oil quantity that is conveyed through the ring channel or the oil gallery and the conveying speed, and thus intensify the cooling of the piston crown. The result is more effective piston cooling.

In this context, embodiments of the internal combustion engine may comprise where the cone of the inlet channel has a concave outer cone lateral surface. A concave outer cone lateral surface assists, at an inlet side, the feed of oil and the introduction into the ring-shaped channel.

In this context, embodiments of the internal combustion engine may comprise where the ring-shaped channel is equipped, on the side situated opposite the inlet channel, with a wedge which projects into the ring-shaped channel. The wedge assists the effect whereby the oil that is introduced via the inlet channel into the ring-shaped channel is directed to both sides of the cone into the ring channel, and thus contributes to more effective piston cooling.

Embodiments of the internal combustion engine may comprise where the inlet channel and the outlet channel are arranged offset with respect to one another by an angle $\alpha$ about the cylinder longitudinal axis.

In one example, two angles are formed if the inlet channel and the outlet channel are arranged offset with respect to one another about the cylinder longitudinal axis, because the inlet channel and the outlet channel are connected to one another via two ring channel sections. Proceeding from the inlet channel, the outlet channel can be reached clockwise or counterclockwise via the ring channel. It is desired the case that the angle is $\alpha \approx 180°$, or both angles are $\alpha \approx 180°$.

In this context, embodiments of the internal combustion engine may comprise where the angle $\alpha > 140°$. The larger the angle, the greater is the minimum distance that the oil introduced into the ring-shaped channel covers in the ring channel.

A further example of the disclosure is based, specifically that of specifying a method for producing a piston of an internal combustion engine of a type described above, is achieved by way of a method which is distinguished by the fact that the piston is produced via an additive manufacturing process, in which the piston is built up in layered fashion.

That which has already been stated with regard to the internal combustion engine according to the disclosure also applies to the method according to the disclosure.

Embodiments of the method are advantageous in which the piston is produced at least inter alia via 3D printing.

Manufacturing methods in which the piston is produced by casting with subsequent cutting machining may basically also be desired.

FIGS. 1-8B show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

FIG. 1 shows, schematically and in a perspective view, the oil gallery 3 together with the inlet channel 3*b* and the outlet channel 3*c* and a section of the cylinder barrel 1 according to the prior art.

A piston which is movable in translational fashion in the cylinder barrel 1 along the cylinder longitudinal axis 1*a* is, according to the prior art, to form an oil-type cooling arrangement, equipped with an oil gallery 3 which is integrated in the piston crown and which comprises a ring-shaped channel 3*a*, an inlet channel 3*b* which is connected to the ring-shaped channel 3*a* and which serves for supplying oil to the ring-shaped channel 3*a*, and an outlet channel 3*c* which is connected to the ring-shaped channel 3*a* and which serves for discharging the oil from the ring-shaped channel 3*a*.

In simplified terms, the cylinder longitudinal axis 1*a* and the piston longitudinal axis form a common, that is to say the same, longitudinal axis. The inlet channel 3*b* and the outlet channel 3*c* emerge from the piston crown at the crankcase side.

The supply of oil to the ring channel 3*a* is performed using an injection nozzle which is arranged so as to be positionally fixed with respect to the cylinder block and which is supplied with oil via a main oil gallery. The injection jet 3*d* emerging from the injection nozzle is oriented toward the inlet channel 3*b*.

The inlet channel 3*b* and the outlet channel 3*c* are arranged offset with respect to one another about the cylinder longitudinal axis 1*a*. Proceeding from the inlet channel 3*b*, the outlet channel 3*c* can be reached clockwise or counterclockwise via the ring channel 3*a*. The angles covered in the process are in the present case in each case $\alpha \approx 180°$. Thus, the two possible distances that the oil introduced into the ring-shaped channel 3*a* covers in the ring channel 3*a* in order to reach the outlet channel 3*c* are approximately equal.

FIG. 2A shows, schematically and in cross section, a section of the ring-shaped channel 3*a* of an oil gallery 3, which ring-shaped channel is integrated in the piston crown 2*a* of a piston 2 and into which ring-shaped channel an inlet channel 3*b* opens, according to a first embodiment of the internal combustion engine. The statements made are supplementary to the prior art according to FIG. 1.

The inlet channel 3*b* is formed so as to taper in a funnel shape in the direction of the ring-shaped channel 3*a* and projects into the ring-shaped channel 3*a* so as to form a cone 3*b*'. The oil introduced via the inlet channel 3*b* into the ring-shaped channel 3*a* impinges on that wall of the ring channel 3*a* which is situated opposite the cone 3*b*', and said oil is diverted. Here, the oil is split up and is directed to both sides of the cone 3*b*' into the ring channel 3*a*.

The cone 3*b*' of the inlet channel 3*b* has a concave outer cone lateral surface which facilitates the feed of oil and the introduction into the ring-shaped channel 3*a*.

The ring-shaped channel 3*a* is equipped, on the side situated opposite the cone 3*b*', with a wedge 5*a* which projects into the ring-shaped channel 3*a*. Said wedge 5*a* is oriented parallel to the cylinder longitudinal axis and assists the splitting-up and introduction of the oil into the ring-shaped channel 3*a* to both sides of the cone 3*b*'. In one example, the wedge 5*a* may split incoming oil from the inlet channel 3*b* as it flows in to the ring-shaped channel 3*a*. Thus, oil flows around an entire circumference of the ring-shaped channel 3*a*, rather than only flowing through one half.

Figure 2B:
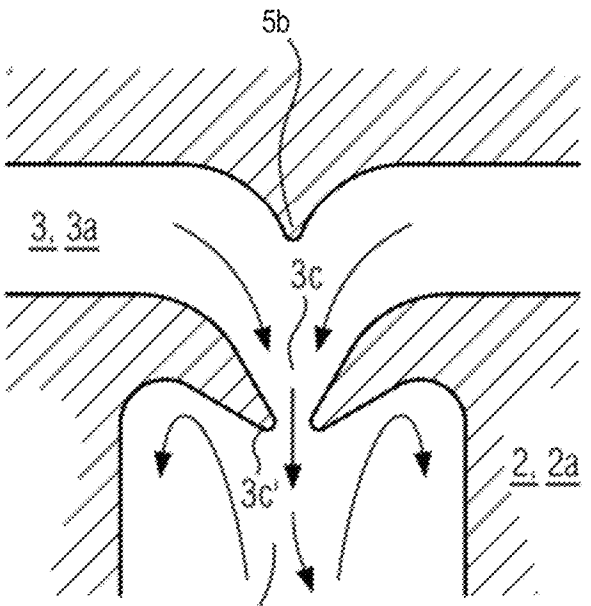
FIG. 2B shows, schematically and in cross section, a section of the ring-shaped channel of the oil gallery, together with the outlet channel branching therefrom, according to the first embodiment of the internal combustion engine.
Figure 2A:
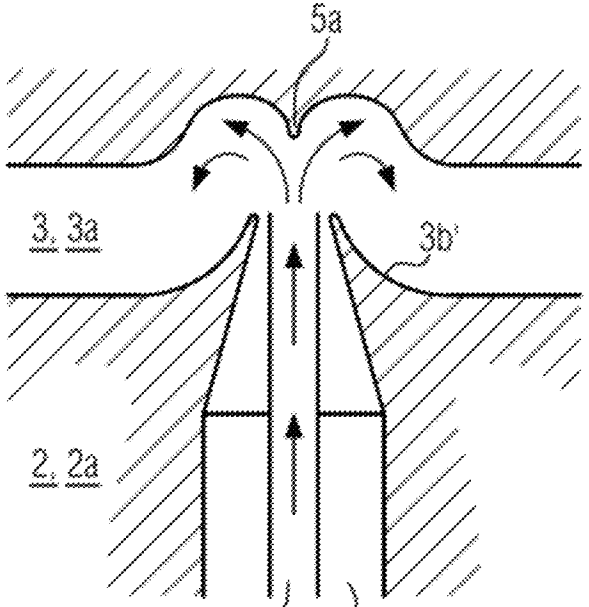
FIG. 2A shows, schematically and in cross section, a section of the ring-shaped channel of the oil gallery, together with the inlet channel opening therein, according to a first embodiment of the internal combustion engine.

FIG. 2B shows, schematically and in cross section, a section of the ring-shaped channel 3*a* of the oil gallery 3, together with the outlet channel 3*c* branching therefrom, according to the first embodiment of the internal combustion engine.

The outlet channel 3*c* is formed so as to taper in a funnel shape proceeding from the ring-shaped channel 3*a* and protrudes from the piston crown 2*a* so as to form a cone 3*c*'. Pockets are provided in the piston crown 3*a* to both sides of the cone 3*c*' of the outlet channel 3*c*, in which pockets oil that has been discharged via the outlet channel 3*c* can be captured. The cone 3*c*' of the outlet channel 3*c* has a concave outer cone lateral surface which assists the capture and discharge of oil situated in the crankcase.

The outlet channel 3*c* which narrows in a funnel shape makes it difficult for the oil that has already been discharged into the crankcase to pass into the outlet channel 3*c* and the ring channel 3*a* again. That is to say, the funnel shape of the outlet channel 3*c*, which decreases in a cross-sectional area in a direction of oil flow, may block oil from re-entering the ring channel 3*a* via the cone 3*c*'.

The ring-shaped channel 3*a* is equipped, on the side situated opposite the cone 3*c*' of the outlet channel 3*c*, with a wedge 5*b* which projects into the ring-shaped channel 3*a* and which assists the discharge of the oil.

In one example, the embodiments of FIGS. 2A and 2B illustrate a system, comprising a piston configured to oscillate along an axis and an oil gallery arranged within the piston configured to route oil circumferentially about the axis, wherein an inlet of the oil gallery comprises a funnel shape narrowing in width in a downstream direction relative to a direction of oil flow from a nozzle to the oil gallery. The nozzle is arranged on the cylinder block directed to the piston. The inlet directs oil toward a wedge of the oil gallery, and wherein the wedge comprises an m-shape with a first semi-circle arranged in a clockwise direction of the inlet and a second semi-circle arranged in a counterclockwise direction of the inlet, wherein a protrusion is arranged between the first semi-circle and the second semi-circle. An outlet of the oil gallery is shaped identically to the inlet of the oil gallery. A first wedge is arranged adjacent to the inlet and a second wedge is arranged adjacent to the outlet, wherein the first wedge is configured to divide oil flow from the inlet to flow in counterclockwise and clockwise direction around the oil gallery, and wherein the second wedge is configured to direct a clockwise oil flow and a counterclockwise oil flow toward the outlet. The outlet comprises a first recess and a second recess surrounding an extreme end of the funnel shape, wherein the first recess and the second recess are convex relative to the oil gallery.

In one example, the funnel shape comprises a conical shape with a changing cross-sectional flow through area along a height of the funnel. In one example, the cross-sectional flow through area decrease uniformly along the height.

Figures 3A, 3B, 3C, 3D:
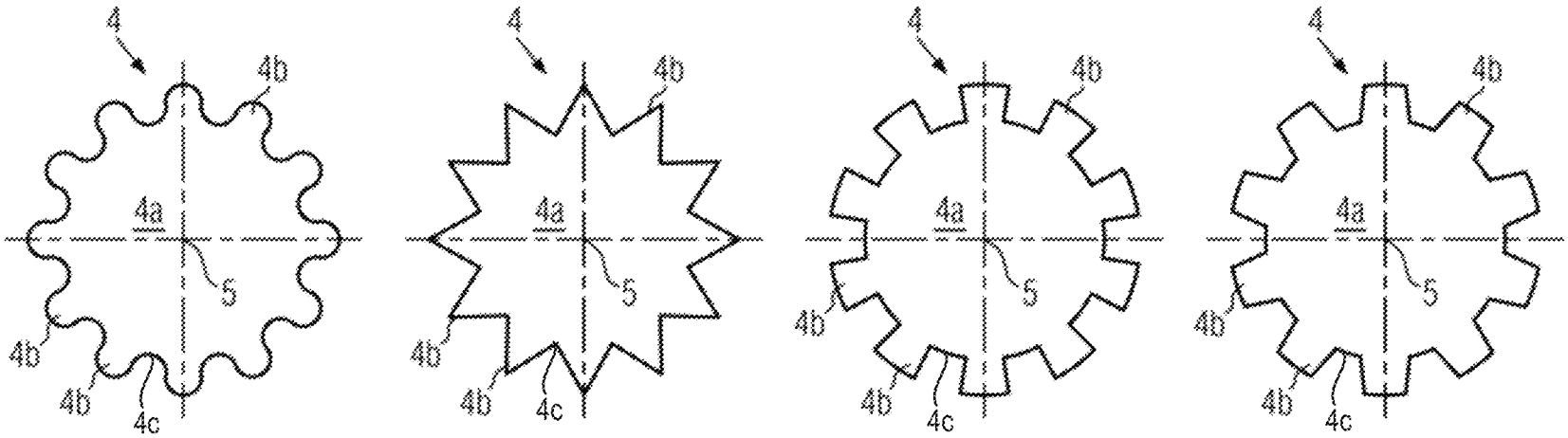
FIG. 3A shows the cross section of the ring-shaped channel of the oil gallery according to the first embodiment of the internal combustion engine as per FIG. 1.
FIG. 3B shows the cross section of the ring-shaped channel of the oil gallery according to a second embodiment of the internal combustion engine
FIG. 3C shows the cross section of the ring-shaped channel of the oil gallery according to a third embodiment of the internal combustion engine
FIG. 3D shows the cross section of the ring-shaped channel of the oil gallery according to a fourth embodiment of the internal combustion engine

Turning now to FIG. 3A, it shows a second embodiment of the ring-shaped channel 3*a*. In the example of FIG. 3A, the ring-shaped channel 3*a* has, over its entire length (e.g., circumference), a cross section 4 which comprises a central piece 4*a* and multiple tongues 4*b*.

Such a cross section 4 increases the size of the heat-transferring area between the ring channel 3*a* and the piston crown, that is to say between the cooling oil and the piston material that is to be cooled.

The tongues 4*b* are arranged circumferentially at regular intervals, are oriented radially outward, and are of the same shape and of the same size. In the first embodiment illustrated in FIG. 3A, the tongues 4*b* have a rounded shape. The tongues 4*b* are of circular form at their free end. The result is a flower-shaped design of the cross section 4, as can be seen from FIG. 3A, which shows the cross section 4 of the ring-shaped channel 3*a* as per FIG. 1. Between adjacent tongues 4*b*, there is arranged an inward recess 4*c*. As such, the tongues 4*b* and the inward recesses 4*c* alternate along a circumference of the ring channel 3*a*. The tongues 4*b* and the inward recesses 4*c* may be shaped identically.

The cross section 4 winds in spiral fashion around a central flow filament 5 along the ring-shaped channel 3*a*. In the left-hand branch of the ring channel 3*a*, the cross section 4 winds clockwise around the central flow filament 5 as viewed in the flow direction. In the right-hand branch of the ring channel 3*a*, the cross section 4 winds counterclockwise. The spiral-shaped winding of the cross section 4 ensures an enlargement of the heat-transferring area between the ring channel 3*a* and the piston crown. The central flow filament 5 forms the longitudinal axis of the ring channel 3*a*, along which the ring channel 3*a* extends and which passes through the central piece 4*a*.

The oil is forced into the tongues 4*b* that wind in a spiral shape, that is to say depressions, and is simultaneously diverted and conveyed along the tongues 4*b* in the direction of an outlet channel 3*c*, by the oscillating piston movement. In this way, the warmed oil is conveyed through the ring channel 3*a* more quickly, whereby the mass flow through the oil gallery 3 can be increased and the cooling of the piston can be improved. Said another way, the tongues 4*b* may increase a flow rate of oil through the ring channel 3*a*.

Turning to FIG. 3B, it schematically shows the cross section 4 of the ring-shaped channel 3*a* of the oil gallery 3 according to a second embodiment of the internal combustion engine. The tongues 4*b* and recesses 4*c* have a triangular shape.

Turning to FIG. 3C, it schematically shows the cross section 4 of the ring-shaped channel 3*a* of the oil gallery 3 according to a third embodiment of the internal combustion engine. The tongues 4*b* and the recesses 4*c* have a rectangular shape.

Turning to FIG. 3D, it schematically shows the cross section 4 of the ring-shaped channel 3*a* of the oil gallery 3 according to a fourth embodiment of the internal combustion engine. The tongues 4*b* and the recesses 4*c* are trapezoidal.

The corners of the tongues 4*b* and recesses 4*c* as per FIGS. 3B, 3C, and 3D may be rounded. The ring channel 3*a* may be compressed or stretched in the direction of the cylinder longitudinal axis 1*a* such that the ring channel 3*a* forms, in terms of its basic shape, not a circle but rather an ellipse, the longer axis of which runs either in the direction of the cylinder longitudinal axis 1*a* or transversely with respect to the cylinder longitudinal axis 1*a*.

Figure 4:
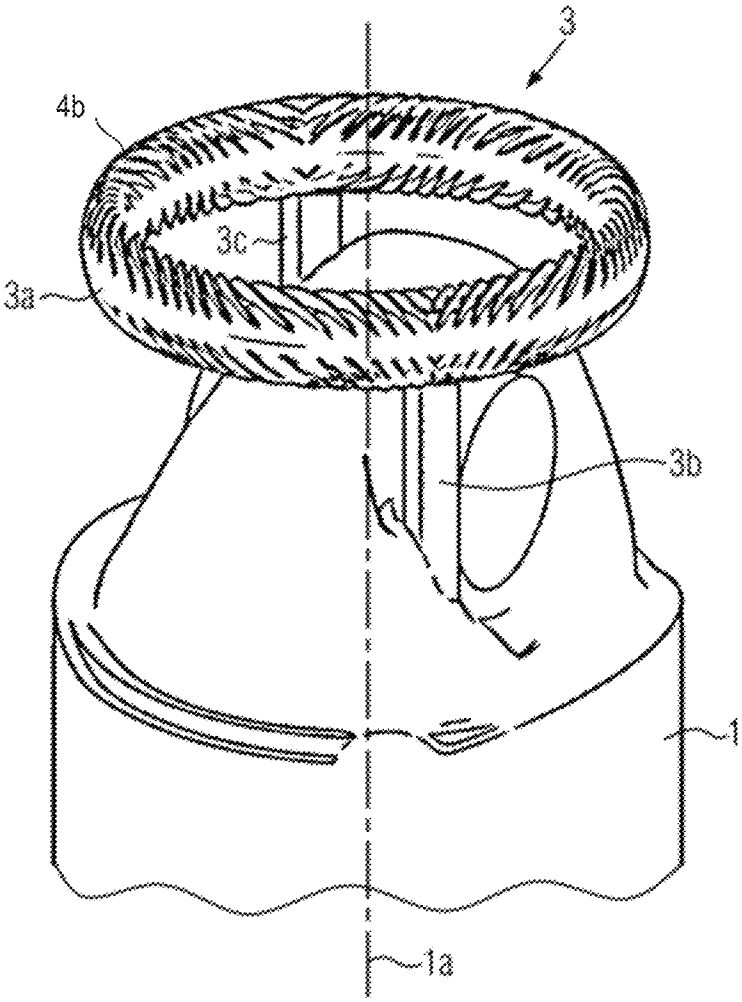
FIG. 4 shows a perspective view of the oil gallery together with the inlet channel and the outlet channel and a section of the cylinder barrel according to a fifth embodiment of the internal combustion engine.

FIG. 4 shows, schematically and in a perspective view, the oil gallery 3 together with the inlet channel 3*b* and the outlet channel 3*c* and a section of the cylinder barrel 1 according to a fifth embodiment of the internal combustion engine.

In some examples, additionally or alternatively, the inlet channel 3*b* and the outlet channel 3*c* may include the first wedge 5*a* and the second edge 5*b* of FIGS. 2A and 2B, respectively. As such, the inlet channel 3*b* may divert oil to the ring channel 3*a*, wherein the oil is divided and forced to flow in a clockwise and a counterclockwise direction. The outlet channel 3*c* may block oil from re-entering the ring channel 3*a* via the cone 3*c'*.

The ring-shaped channel 3*a* has no tongues 4*b* on its outermost circumference, and is thus smooth on its outermost circumference. It is thus prevented that the vertical movement of the oil in the gallery 3, caused by the oscillating piston movement in the direction of the cylinder longitudinal axis 1*a*, is not slowed in the central part by tongues 4*b*, but rather is accelerated without disruption in the direction of the upper and lower walls, whereby the cooling is improved. Said another way, the tongues 4*b* may be arranged on surfaces of the ring-shaped channel 3*a* facing directions parallel to the longitudinal axis 1*a*. In one example, additionally or alternatively, the inner circumference of the ring-shaped channel 3*a* may also be free of the tongues 4*b*.

Figure 5:
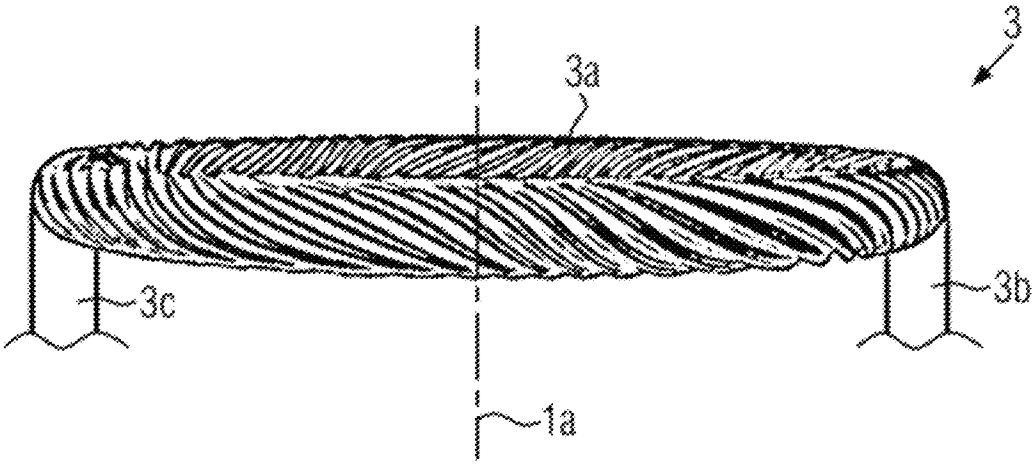
FIG. 5 shows a perspective view of the oil gallery together with the inlet channel and the outlet channel according to a sixth embodiment of the internal combustion engine.

FIG. 5 shows, schematically and in a side view, the oil gallery 3 together with the inlet channel 3*b* and the outlet channel 3*c* according to a sixth embodiment of the internal combustion engine.

The ring-shaped channel 3*a* with its spiral-shaped winding of the cross section 4 is stretched in certain sections and compressed in certain sections along the central flow filament, such that the local pitch of the spiral, that is to say of the spiral-shaped winding, varies.

In FIG. 5, it is possible to see a clearly varying local pitch of the spiral. In this way, the local horizontal speed of the oil in the direction of the outlet channel 3*c* is changed or varied, whereby varying cooling of the piston regions can be realized. The aim is a more homogeneous, or homogeneous, temperature distribution in the piston.

In one example, the embodiments of FIGS. 3A through 5 illustrate an engine system, comprising a piston configured to oscillate along an axis and an oil gallery arranged within the piston configured to route oil circumferentially about the axis, wherein the oil gallery comprises a plurality of tongues and a plurality of recesses alternatingly arranged along a circumference of the oil gallery. The circumference is between a largest circumference and a smallest circumference of the oil gallery, and wherein the plurality of tongues and the plurality of recesses face directions parallel to the axis. The plurality of recesses and the plurality of tongues alternate such that a recess is arranged between adjacent tongues and a tongue is arranged between adjacent recesses. The plurality of recess and the plurality of tongues comprise one or more of a semi-circular, triangular, square, and trapezoidal shape. Corners of the plurality of tongues and the plurality of recesses are curved. The oil gallery comprises an ellipse shape. The plurality of recesses and the plurality of tongues are arranged equidistantly around the circumference.

Figure 6:
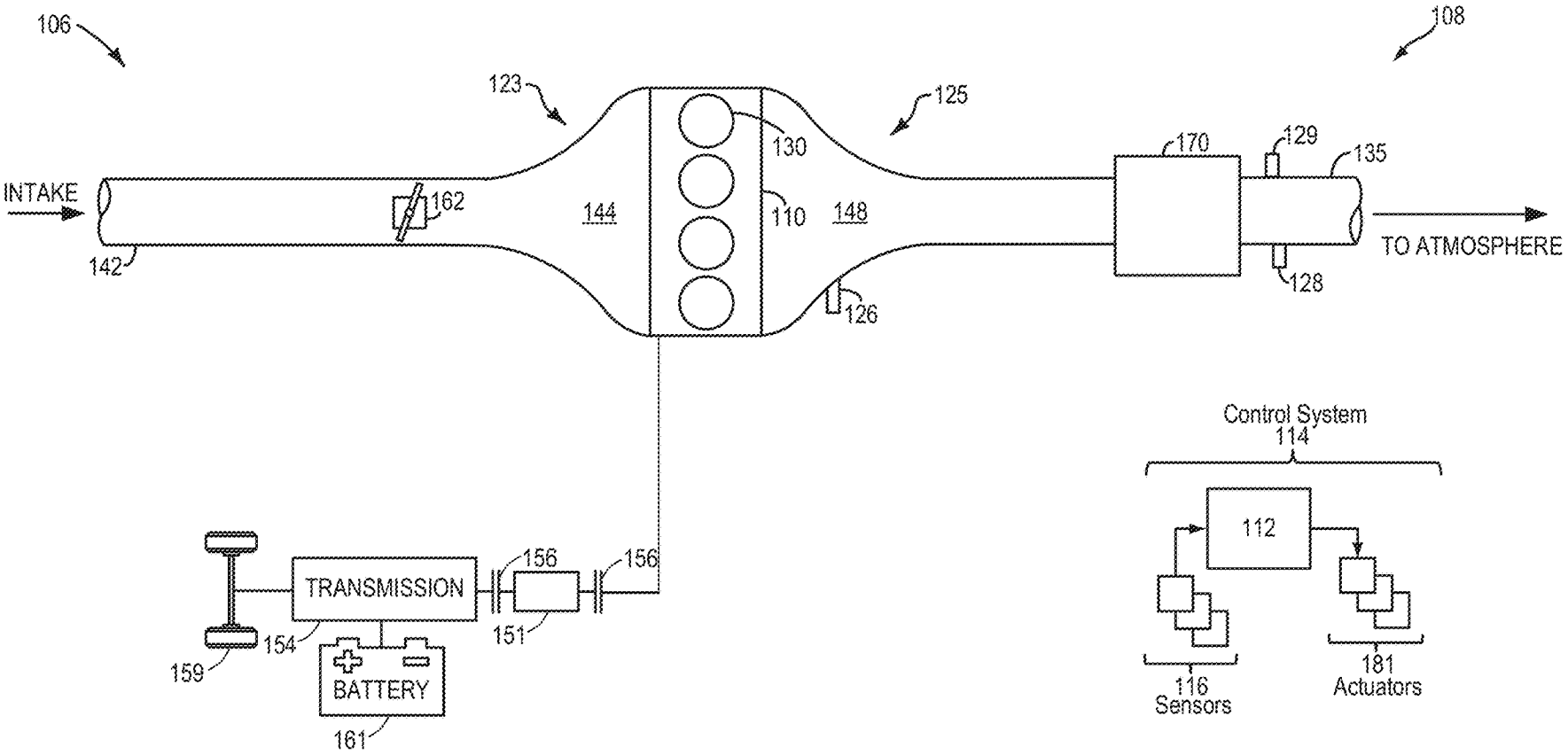
FIG. 6 shows an example of an engine of a hybrid vehicle.

FIG. 6 shows a schematic depiction of a hybrid vehicle system 106 that can derive propulsion power from engine system 108 and/or an on-board energy storage device. An energy conversion device, such as a generator, may be operated to absorb energy from vehicle motion and/or engine operation, and then convert the absorbed energy to an energy form suitable for storage by the energy storage device.

Engine system 108 may include an engine 110 having a plurality of cylinders 130. As such, the cylinder 2 may be one cylinder of the plurality of cylinders 130. Engine 110 includes an engine intake 123 and an engine exhaust 125. Engine intake 123 includes an air intake throttle 162 fluidly coupled to the engine intake manifold 144 via an intake passage 142. Engine exhaust 125 includes an exhaust manifold 148 leading to an exhaust passage 135 that routes exhaust gas to the atmosphere. Engine exhaust 125 may include one or more emission control devices 170 mounted in a close-coupled position or in a far underbody position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein.

Vehicle system 106 may further include control system 114. Control system 114 is shown receiving information from a plurality of sensors 116 (various examples of which are described herein) and sending control signals to a plurality of actuators 181 (various examples of which are described herein). As one example, sensors 116 may include exhaust gas sensor 126 located upstream of the emission control device, temperature sensor 128, and pressure sensor 129. Other sensors such as additional pressure, temperature, air/fuel ratio, and composition sensors may be coupled to various locations in the vehicle system 106. As another example, the actuators may include the throttle 162.

Controller 112 may be configured as a conventional microcomputer including a microprocessor unit, input/output ports, read-only memory, random access memory, keep alive memory, a controller area network (CAN) bus, etc. Controller 112 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines.

In some examples, hybrid vehicle 106 comprises multiple sources of torque available to one or more vehicle wheels 159. In other examples, vehicle 106 is a conventional vehicle with only an engine, or an electric vehicle with only electric machine(s). In the example shown, vehicle 106 includes engine 110 and an electric machine 151. Electric machine 151 may be a motor or a motor/generator. A crankshaft of engine 110 and electric machine 151 may be connected via a transmission 154 to vehicle wheels 159 when one or more clutches 156 are engaged. In the depicted example, a first clutch 156 is provided between a crankshaft and the electric machine 151, and a second clutch 156 is provided between electric machine 151 and transmission 154. Controller 112 may send a signal to an actuator of each clutch 156 to engage or disengage the clutch, so as to connect or disconnect crankshaft from electric machine 151 and the components connected thereto, and/or connect or disconnect electric machine 151 from transmission 154 and the components connected thereto. Transmission 154 may be a gearbox, a planetary gear system, or another type of transmission. The powertrain may be configured in various manners including as a parallel, a series, or a series-parallel hybrid vehicle.

Electric machine 151 receives electrical power from a traction battery 161 to provide torque to vehicle wheels 159. Electric machine 151 may also be operated as a generator to provide electrical power to charge battery 161, for example during a braking operation.

Figure 7:
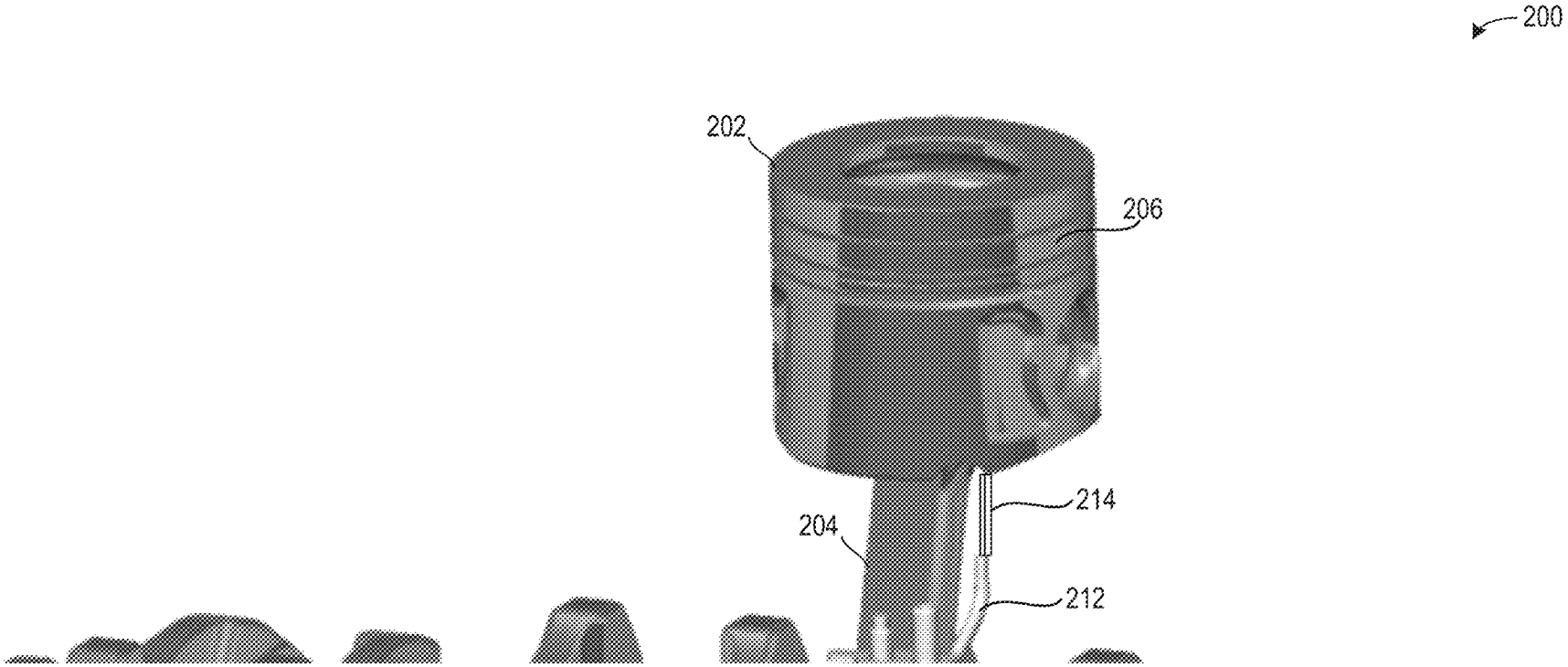
FIG. 7 shows an example of a piston comprising an internal oil gallery and a nozzle.

Turning to FIG. 7, it shows an embodiment 200 of a piston 202 coupled to a connecting rod 204. The piston 202 may be arranged in a cylinder of the engine 110 of FIG. 6. The piston 202 comprises an internal oil gallery 206 which may receive oil from a nozzle 212. The nozzle 212 is fluidly coupled to an oil jet 214 (e.g., an oil spray), which is configured to feed oil to the oil gallery 206. In one example, the internal oil gallery 206 may be identical to the oil gallery 3*a* of FIGS. 2A through 5.

In one example, the piston 202 may be configured to oscillate along an axis within a cylinder of an engine. The oil gallery 206 is arranged within the piston and configured to route oil circumferentially about the axis; wherein an inlet of the oil gallery comprises a funnel shape narrowing in width in a downstream direction relative to a direction of oil flow from an oil jet to the oil gallery, and wherein the oil gallery comprises a plurality of tongues and a plurality of recesses alternatingly arranged along a circumference of the oil gallery. An outlet of the oil gallery is shaped identically to the inlet of the oil gallery, and wherein the outlet comprises a first recess and a second recess surrounding an extreme end of the funnel shape, wherein the first recess and the second recess are convex relative to the oil gallery. The outlet is 180 degrees away from the inlet along the oil gallery. The plurality of tongues and the plurality of recesses comprise one or more of a semi-circular, a triangular, a square, and a trapezoidal shape. In one example, are no other inlets or additional outlets other than the inlet and an outlet. In this way, the embodiment 200 may include one or more of the embodiments illustrated in FIGS. 2A through 5.

Figure 8B:
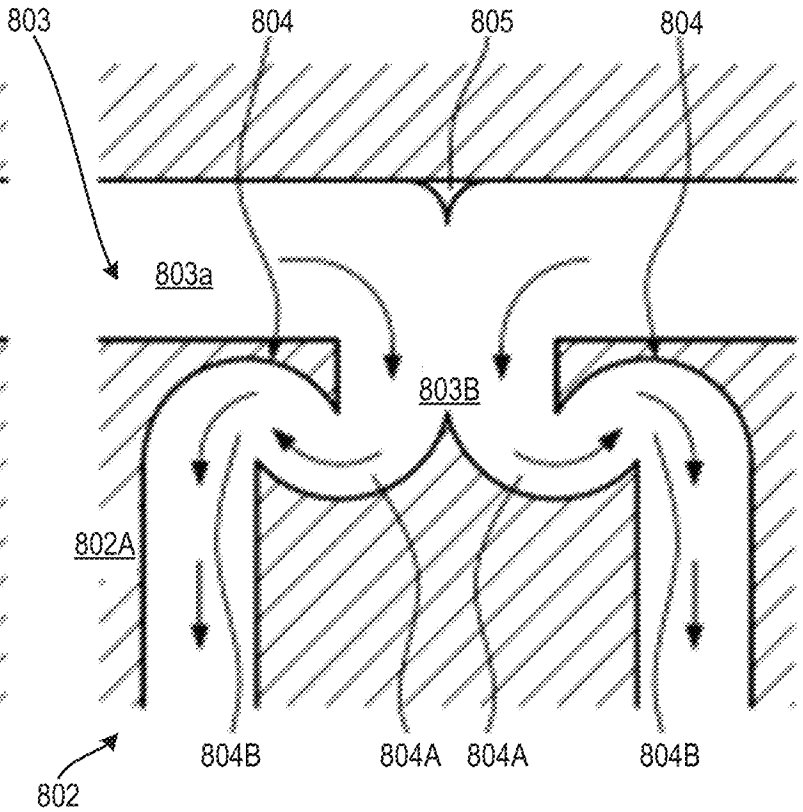
FIG. 8B shows, schematically and in cross section, a section of the ring-shaped channel of the oil gallery, together with the branching-off outlet channel, according to an eighth embodiment of the internal combustion engine.
Figure 8A:
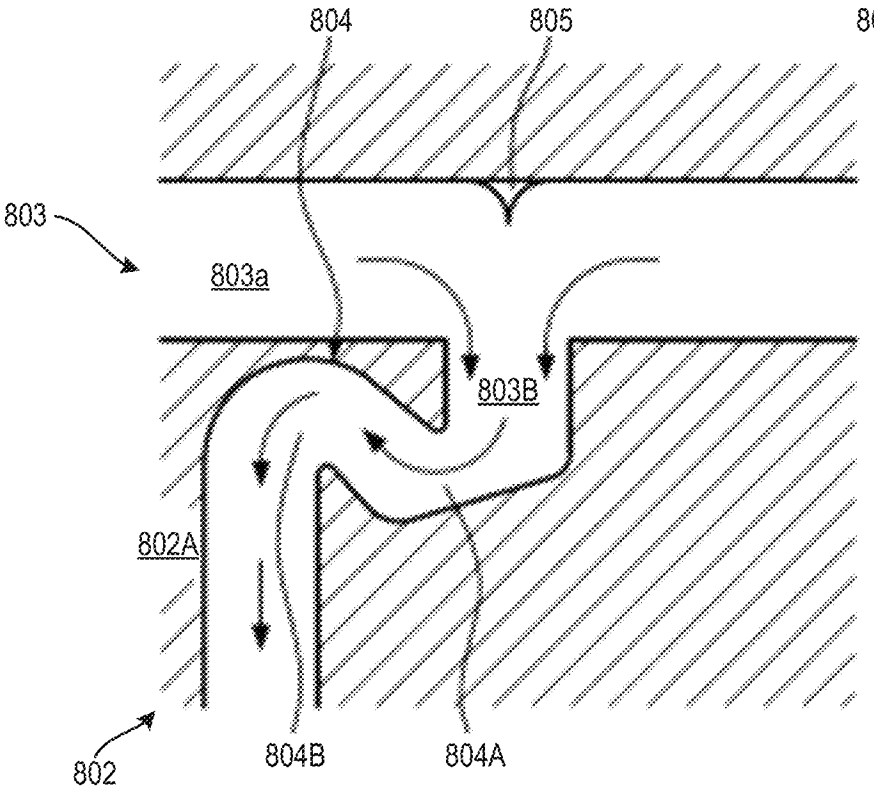
FIG. 8A shows, schematically and in cross section, a section of the ring-shaped channel of the oil gallery, together with the branching-off outlet channel, according to a seventh embodiment of the internal combustion engine.

FIG. 8A shows, schematically and in cross section, a section of the ring-shaped channel 803*a* of an oil gallery 803, which ring-shaped channel is integrated in the piston crown 802*a* of a piston 802, together with the branching-off outlet channel 803*b*, according to a first embodiment of the internal combustion engine. The example of FIG. 8A, including the piston 802 and the oil gallery 803 may be a non-limiting example of the oil gallery 3*a* of FIGS. 2A-5 and the piston 202 of FIG. 7. In one example, the ring-shaped channel 803*a* may comprise the tongues 4*b* of FIGS. 3A-3D without departing from the scope of the present disclosure.

The outlet channel 803*b* has a siphon-like section 804 which comprises two bends 804*a*, 804*b*, wherein the two bends 804*a*, 804*b* have different curvatures.

Proceeding from the ring-shaped channel 803*a* of the oil gallery 803, the outlet channel 803*b* runs initially parallel to the cylinder longitudinal axis and, downstream as viewed in a flow direction, curves firstly clockwise to the right before subsequently curving anticlockwise to the left. The change in direction that the channel 803*b* undergoes owing to a curvature determines the angle $\gamma_i$ of the respective bend. In the present case, the channel 803*b*, at the first bend 804*a*, curves to the right by an angle $\gamma_i \approx 110°$ and, at the second bend 804*b*, curves to the left by an angle $\gamma_2 \approx 110°$. Downstream of the siphon 804, the channel 803*b* extends parallel to the cylinder longitudinal axis again.

After passing the first bend 804*a*, oil that has been introduced into the labyrinthine outlet channel 803*b* does not enter the ring-shaped channel 803*a* again. Rather, the oscillating stroke movement of the piston gives rise to a shaker effect which conveys the oil into the crankcase by shaking.

The illustrated configuration or shaping of the outlet channel 803*b* ensures an effective discharge of the oil from the oil gallery 803, and thereby improves the oil-type cooling arrangement of the piston 802.

The ring-shaped channel 803*a* is equipped, on the side situated opposite the outlet channel 803*b*, with a wedge 805 which projects into the ring-shaped channel 803*a*. The wedge 805 is oriented parallel to the cylinder longitudinal axis and assists the collection and discharge of the oil from the ring-shaped channel 803*a* via the outlet channel 803*b*.

FIG. 8*b* shows, schematically and in cross section, a section of the ring-shaped channel 803*a* of the oil gallery 803, which ring-shaped channel is integrated in the piston crown 802*a* of the piston 802, together with the branching-off outlet channel 803*b*, according to a second embodiment of the internal combustion engine. It is sought to explain the additional features in relation to FIG. 8*a*, and reference is made otherwise to FIG. 8*a*.

The outlet channel 803*b* has two siphon-like sections 804 which each comprise two bends 804*a*, 804*b*, wherein the two bends 804*a*, 804*b* have different curvatures.

In one example, the first bends 804A extend in opposite directions relative to one another. That is to say, a first bend of a first siphon-like section 804 extends in a clockwise direction and a first bend of a second siphon-like section 804 extends in a counterclockwise direction. The first bends 804*a* may be concave relative to the ring-shaped channel 803*a*. The second bends 804B extend in opposite directions relative to one another. The second bend of the first siphon-like section 804 extends in the clockwise direction the second bend of the second siphon-like section 804 extends in the counterclockwise direction. The second bends 804*b* may be curved oppositely to that of the first bends 804*a* such that the second bends 804*b* are convex relative to the ring-shaped channel 803*a*. In one example, a combination of the first bend and the second bend form a U-shaped bend. Additionally or alternatively, the first bend and the second bend may form a sinusoidal shape. The combination of the first bend and the second bend may be to block fluids from entering the oil gallery 803 via the outlet channel 803*b*. In this way, expelling of oil from the oil gallery 803 may be enhanced, which may enhance cooling of the piston 802 overall.

An embodiment of an internal combustion engine includes at least one cylinder head with at least one cylinder, and at least one cylinder block, which is connected to the at least one cylinder head and which serves as an upper crankcase half, for accommodating at least one piston, in which internal combustion engine. Each cylinder comprises a combustion chamber which is jointly formed by a piston crown of the cylinder-specific piston, by a cylinder barrel and by the at least one cylinder head, wherein the piston is displaceable in translational fashion along a cylinder longitudinal axis between a top dead center TDC and a bottom dead center BDC, forming a piston stroke s. Each piston is, to form an oil-type cooling arrangement, equipped with an oil gallery which is integrated in the piston crown and which comprises a ring-shaped channel, an inlet channel which is connected to the ring-shaped channel and which serves for supplying oil to the ring-shaped channel, and an outlet channel which is connected to the ring-shaped channel and which serves for discharging the oil from the ring-shaped channel. The inlet channel is formed so as to taper in a funnel shape in the direction of the ring-shaped channel and projects into the ring-shaped channel so as to form a cone. A first example of the engine further includes where the inlet channel and/or the outlet channel is oriented parallel to the cylinder longitudinal axis. A second example of the engine, optionally including the first example, further includes where an injection nozzle which is arranged so as to be positionally fixed relative to the cylinder block is provided for supplying oil to the ring-shaped channel. A third example of the engine, optionally including one or more of the previous examples, further includes where the inlet channel, which is of funnel-shaped form at least in certain sections, has a minimum diameter $D_{min}$, where $D_{min}>d_{oil}$, wherein $d_{oil}$ denotes the diameter of an outlet opening of the injection nozzle. A fourth example of the engine, optionally including one or more of the previous examples, further includes where the inlet channel, which is of funnel-shaped form at least in certain sections, has a maximum diameter $D_{max}$, where $D_{max}>1.5\ D_{min}$, wherein $D_{min}$ denotes a minimum diameter of the inlet channel, which is of funnel-shaped form at least in certain sections. A fifth example of the engine, optionally including one or more of the previous examples, further includes where the following applies: $D_{max}>2\ D_{min}$. A sixth example of the engine, optionally including one or more of the previous examples, further includes where the following applies: $D_{max}>3\ D_{min}$. A seventh example of the engine, optionally including one or more of the previous examples, further includes where the ring-shaped channel is equipped, on the side situated opposite the cone, with a wedge which projects into the ring-shaped channel. An eighth example of the engine, optionally including one or more of the previous examples, further includes where the wedge extends and is oriented parallel to the cylinder longitudinal axis. A ninth example of the engine, optionally including one or more of the previous examples, further includes where the inlet channel and the outlet channel are arranged offset with respect to one another by an angle $\alpha$ about the cylinder longitudinal axis. A tenth example of the engine, optionally including one or more of the previous examples, further includes where the following applies: $\alpha>140°$. An eleventh example of the engine, optionally including one or more of the previous examples, further includes where the outlet channel is formed so as to taper in a funnel shape proceeding from the ring-shaped channel and protrudes from the piston crown so as to form a cone. A twelfth example of the engine, optionally including one or more of the previous examples, further includes where the cone of the inlet channel and/or the cone of the outlet channel has a concave outer shell lateral surface.

An embodiment of an internal combustion engine includes at least one cylinder head with at least one cylinder, and at least one cylinder block, which is connected to the at least one cylinder head and which serves as an upper crankcase half, for accommodating at least one piston, in which internal combustion engine. Each cylinder comprises a combustion chamber which is jointly formed by a piston crown of the cylinder-specific piston, by a cylinder barrel and by the at least one cylinder head, wherein the piston is displaceable in translational fashion along a cylinder longitudinal axis between a top dead center TDC and a bottom dead center BDC, forming a piston stroke s. Each piston is, to form an oil-type cooling arrangement, equipped with an oil gallery which is integrated in the piston crown and which comprises a ring-shaped channel, an inlet channel which is connected to the ring-shaped channel and which serves for supplying oil to the ring-shaped channel, and an outlet channel which is connected to the ring-shaped channel and which serves for discharging the oil from the ring-shaped channel. The ring-shaped channel has, at least in certain sections, a cross section which comprises a central piece and multiple tongues, wherein the tongues are arranged circumferentially and so as to be oriented outward. A first example of the engine further includes where the tongues are arranged circumferentially and so as to be oriented radially outward. A second example of the engine, optionally including the first example, further includes where the tongues are arranged circumferentially at regular intervals. A third example of the engine, optionally including one or more of the previous examples, further includes where the tongues are arranged circumferentially at irregular intervals. A fourth example of the engine, optionally including one or more of the previous examples, further includes where at least two tongues are of different size and/or have a different shape. A fifth example of the engine, optionally including one or more of the previous examples, further includes where the tongues are of the same shape and of the same size. A sixth example of the engine, optionally including one or more of the previous examples, further includes where at least one tongue has a polygonal shape. A seventh example of the engine, optionally including one or more of the previous examples, further includes where at least one tongue has a triangular shape. An eighth example of the engine, optionally including one or more of the previous examples, further includes where at least one tongue has a rounded shape. A ninth example of the engine, optionally including one or more of the previous examples, further includes where at least one tongue has a rectangular shape. A tenth example of the engine, optionally including one or more of the previous examples, further includes where at least one tongue is trapezoidal. An eleventh example of the engine, optionally including one or more of the previous examples, further includes where the cross section winds in spiral fashion around a central flow filament along the ring-shaped channel. A twelfth example of the engine, optionally including one or more of the previous examples, further includes where the ring-shaped channel is stretched or compressed in certain sections with the spiral-shaped winding of the cross section along the central flow filament, such that the local pitch of the spiral-shaped winding varies. A thirteenth example of the engine, optionally including one or more of the previous examples, further includes where the ring-shaped channel has no tongues on the outermost circumference, and is therefore smooth in that region of the oil gallery. A fourteenth example of the engine, optionally including one or more of the previous examples, further includes where the spiral-shaped channel meanders at least in certain sections. A fifteenth example of the engine, optionally including one or more of the previous examples, further includes where an injection nozzle which is arranged so as to be positionally fixed relative to the cylinder block is provided for supplying oil to the ring-shaped channel.

An embodiment of an internal combustion engine includes at least one cylinder head with at least one cylinder and at least one cylinder block, which is connected to the at least one cylinder head and which serves as an upper crankcase half, for accommodating at least one piston, in which internal combustion engine. Each cylinder comprises a combustion chamber which is jointly formed by a piston crown of the cylinder-specific piston, by a cylinder barrel and by the at least one cylinder head, wherein the piston is displaceable in translational fashion along a cylinder longitudinal axis between a top dead center TDC and a bottom dead center BDC, forming a piston stroke s, and each piston is, to form an oil-type cooling arrangement, equipped with an oil gallery which is integrated in the piston crown and which comprises a ring-shaped channel, an inlet channel which is connected to the ring-shaped channel and which serves for supplying oil to the ring-shaped channel, and an outlet channel which is connected to the ring-shaped channel and which serves for discharging the oil from the ring-shaped channel, wherein the outlet channel has at least one siphon-like section comprising n≥2 bends through an angle $\gamma_i$, wherein successive bends have different curvatures. A first example of the engine further includes where the inlet channel and/or the outlet channel is oriented parallel to the cylinder longitudinal axis. A second example of the engine, optionally including the first example, further includes where an injection nozzle which is arranged so as to be positionally fixed relative to the cylinder block is provided for supplying oil to the ring-shaped channel. A third example of the engine, optionally including one of the previous examples, further includes where the outlet channel is formed so as to initially taper in a funnel shape proceeding from the ring-shaped channel. A fourth example of the engine, optionally including one of the previous examples, further includes where the ring-shaped channel is equipped, on the side situated opposite the outlet channel, with a wedge which projects into the ring-shaped channel. A fifth example of the engine, optionally including one of the previous examples, further includes where the wedge extends and is oriented parallel to the cylinder longitudinal axis. A sixth example of the engine, optionally including one of the previous examples, further includes where the at least one siphon-like section is of substantially S-shaped form. A seventh example of the engine, optionally including one of the previous examples, further includes where the at least one siphon-like section comprises two bends. An eighth example of the engine, optionally including one of the previous examples, further includes where for the angle $\gamma_i$, the following applies: $\gamma_i \geq 60°$. A ninth example of the engine, optionally including one of the previous examples, further includes where, for the angle $\gamma_i$, the following applies: $\gamma_i \geq 90°$. A tenth example of the engine, optionally including one of the previous examples, further includes where, for the angle $\gamma_i$, the following applies: $\gamma_i \geq 100°$. An eleventh example of the engine, optionally including one of the previous examples, further includes where, for the angle $\gamma_i$, the following applies: $\gamma_i \geq 115°$.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

a piston configured to oscillate along an axis; and an oil gallery arranged within the piston configured to route oil circumferentially about the axis; wherein an inlet of the oil gallery comprises a funnel shape narrowing in width in a downstream direction relative to a direction of oil flow from a nozzle to the oil gallery, and an outlet of the oil gallery comprises a first concave bend and a second convex bend relative to the oil gallery.

2. The system of claim 1, wherein the nozzle is arranged on a cylinder block directed to the piston.

3. The system of claim 1, wherein the inlet directs oil toward a wedge of the oil gallery, and wherein the wedge comprises an m-shape with a first semi-circle arranged in a clockwise direction of the inlet and a second semi-circle arranged in a counterclockwise direction of the inlet, wherein a protrusion is arranged between the first semi-circle and the second semi-circle.

4. The system of claim 1, wherein an outlet of the oil gallery is shaped identically to the inlet of the oil gallery.

5. The system of claim 4, wherein a first wedge is arranged adjacent to the inlet and a second wedge is arranged adjacent to the outlet, wherein the first wedge is configured to divided oil flow from the inlet to flow in counterclockwise and clockwise direction around the oil gallery, and wherein the second wedge is configured to direct a clockwise oil flow and a counterclockwise oil flow toward the outlet.

6. The system of claim 4, wherein the outlet comprises a first recess and a second recess surrounding an extreme end of the funnel shape, wherein the first recess and the second recess are convex relative to the oil gallery.

7. The system of claim 1, wherein an outlet of the oil gallery comprises a first siphon portion and a second siphon portion each comprising a first concave bend and a second convex bend relative to the oil gallery.

8. An engine system, comprising:

a piston configured to oscillate along an axis; and an oil gallery arranged within the piston configured to route oil circumferentially about the axis; wherein the oil gallery comprises a plurality of tongues and a plurality of recesses alternatingly arranged along a circumference of the oil gallery, and an inlet and an outlet, wherein the inlet comprises a funnel shape, and the outlet comprises a first concave bend and a second convex bend relative to the oil gallery.

9. The engine system of claim 8, wherein the circumference is between a largest circumference and a smallest circumference of the oil gallery, and wherein the plurality of tongues and the plurality of recesses face directions parallel to the axis.

10. The engine system of claim 8, wherein the plurality of recesses and the plurality of tongues alternate such that a recess is arranged between adjacent tongues and a tongue is arranged between adjacent recesses.

11. The engine system of claim 8, wherein the plurality of recesses and the plurality of tongues comprise one or more of a semi-circular, triangular, square, and trapezoidal shape.

12. The engine system of claim 8, wherein corners of the plurality of tongues and the plurality of recesses are curved.

13. The engine system of claim 8, wherein the oil gallery comprises an ellipse shape.

14. The engine system of claim 8, wherein the plurality of recesses and the plurality of tongues are arranged equidistantly around the circumference.

15. A system, comprising:

a piston configured to oscillate along an axis within a cylinder of an engine;

an oil gallery arranged within the piston configured to route oil circumferentially about the axis; wherein an inlet of the oil gallery comprises a funnel shape narrowing in width in a downstream direction relative to a direction of oil flow from an oil jet to the oil gallery, and wherein the oil gallery comprises a plurality of tongues and a plurality of recesses alternatingly arranged along a circumference of the oil gallery, and an outlet of the oil gallery comprises one or more S-shaped curves.

16. The system of claim 15, wherein an outlet of the oil gallery is shaped identically to the inlet of the oil gallery, and wherein the outlet comprises a first recess and a second recess surrounding an extreme end of the funnel shape, wherein the first recess and the second recess are convex relative to the oil gallery.

17. The system of claim 16, wherein the outlet is 180 degrees away from the inlet along the oil gallery.

18. The system of claim 15, wherein there are no other inlets or additional outlets other than the inlet and an outlet.

* * * * *